US005812049A

United States Patent [19]

Uzi

[11] Patent Number: 5,812,049

[45] Date of Patent: Sep. 22, 1998

[54] SYSTEM AND METHOD FOR MONITORING A COMPETITIVE ACTIVITY

[75] Inventor: Moshe Uzi, Netanya, Israel

[73] Assignee: Micro Utility Ltd., Netanya, Israel

[21] Appl. No.: 738,219

[22] Filed: Oct. 25, 1996

[51] Int. Cl.[6] ..... G08B 23/00

[52] U.S. Cl. ..... 340/323 R; 368/2; 368/10

[58] Field of Search ..... 340/323 R; 368/2, 368/10

[56] References Cited

U.S. PATENT DOCUMENTS

| | | | |
|---|---|---|---|
| 3,944,763 | 3/1976 | Beierwaltes | 200/52 R |
| 4,449,114 | 5/1984 | Fascenda et al. | 340/323 R |
| 5,091,895 | 2/1992 | Chatwin et al. | 340/323 R |
| 5,194,843 | 3/1993 | Jones et al. | 340/323 R |
| 5,436,611 | 7/1995 | Arlinghaus, Jr. | 340/323 R |
| 5,511,045 | 4/1996 | Sasaki et al. | 340/323 R |

*Primary Examiner*—Edward Lefkowitz
*Attorney, Agent, or Firm*—Fitch, Even, Tabin & Flannery

[57] ABSTRACT

A system for monitoring the time and location of a participant in a competitive activity, which includes memory apparatus for storing event performance parameters and the identity of the participant; clock apparatus, for determining event times of the participant; control apparatus, associated with the clock apparatus and the memory apparatus, for receiving as input data the event times of the participant, and for determining event performance parameters in accordance therewith, and for storing the parameters in the memory apparatus; and event duration measuring apparatus associated with the control apparatus; the event duration apparatus including first tactile apparatus associated with the clock apparatus, for automatically starting the clock apparatus in response to a first predetermined tactile input, and second tactile apparatus for providing an output signal to the clock apparatus in response to each of one or more second predetermined tactile inputs, wherein the clock apparatus is operative to provide output indications of clocked times at which the tactile inputs occur, and wherein the control apparatus is operative to record and process the clocked times; there also being provided apparatus for remotely identifying the participant, immediately prior to the first and second tactile events, and for providing the identity to the control apparatus, wherein the control apparatus is operative to store the clocked times in association with the participant.

3 Claims, 9 Drawing Sheets

LARGE DISPLAY PANEL
STARTER
COACH SYSTEM (LAPTOP)
ADMINISTRATION PANEL
HUB
DISPLAY
MICRO-CONTROLLER
MEMORY
REMOTE DISPLAY
RECEIVER
ANTENNA
ANTENNA
TAG READER
DISPLAY
MICRO-PROCESSOR
KEYBOARD
RTC
MEMORY
LANE TIMER
OPT. COUPLING
SWIM PANEL
REAL TIME CLOCK
MEMORY
ANTENNA
MICRO-CONTROLLER
TAG-READER
JUMP/START PAD
A
B
10
11
12
14
18
19
20
100
102
104
105
106
108
110
112
114
300
302
304
306
308
310
400
402
404
406
408
410

SYSTEM AND METHOD FOR MONITORING A COMPETITIVE ACTIVITY

FIELD OF THE INVENTION

The present invention relates to timing and location of multiple participants in sporting.

BACKGROUND OF THE INVENTION

In many areas, it is desired to time duration of events and to determine various parameters associated with the timed events. One such area is that of competitive sports, such as swimming, running, indoor cycling, and so on. The need for event timing exists both at competition level, where a large number of participants may be competing against each other simultaneously, and at training level, in which a trainer may need to analyze the performance and fitness of each member of a team, and may thus also seek to design individualized training programs for each team member. Individuals may also seek to time themselves and to analyze their own performances.

Most sporting event timing and analysis, such as mentioned above, is carried out manually, either by use of manual or electronic timing devices and systems. The most advanced systems are normally employed at large sporting events, and are typically capable of determining the finish times of the first predetermined number of finishers, such as in running races. In swimming competitions, each swimmer is normally timed separately, either by means of a judge operating a stopwatch, for example, or by means of an automated system that is capable of timing an individual swimmer in a single swimming lane. At training level, it is impossible for a single swimming trainer to follow each individual team member the whole time, and thus any analysis of any given team members performance and training needs is, by definition, very superficial.

As more and more people have taken up swimming in recent years, swimming pools have become more crowded to the extent that several swimmers may be swimming in the same lane simultaneously. This is a trend that seeks to naturally extend itself to competitive swimming events, but which is not generally permitted because of the difficulty in timing individual swimmers in the same lane.

Furthermore, while many individuals seek to time their own performances while training, this is something that is not always possible. For example, while a jogger running along a predetermined route can know approximately how far he has run and can time himself reasonably accurately with a stopwatch, a swimmer cannot time himself properly as he will be unlikely to carry a stopwatch with him into the swimming pool and, furthermore, when swimming a large number of identical lengths, it is not always possible for him to remember constantly bow many laps he has swum.

Disclosed in U.S. Pat. No. 3,944,763, entitled "Swimming Pool Touch Pad," is a pad device which is adapted to be mounted onto the wall of a swimming pool, and which contains an electrical circuit which is closed in response to pressure applied, as by a swimmer. The touch pad is intended for use in swimming pools for race initiation and termination.

SUMMARY OF THE INVENTION

The present invention seeks to provide a system for monitoring time and location parameters of a plurality of simultaneous participants in competitive activities.

The present invention further seeks to provide multiple participant recognition apparatus for identifying a plurality of participants and for enabling simultaneous timing and real time performance analysis of each participant individually.

There is thus provided, in accordance with a preferred embodiment of the invention, a system for monitoring the time and location of a participant in a competitive activity, which includes:

memory apparatus for storing event performance parameters and the identity of the participant; clock apparatus, for determining event times of the participant; control apparatus, associated with the clock apparatus and the memory apparatus, for receiving as input data the event times of the participant, and for determining event performance parameters in accordance therewith, and for storing the parameters in the memory apparatus; and event duration measuring apparatus associated with the control apparatus.

The event duration apparatus includes first tactile apparatus associated with the clock apparatus, for automatically starting the clock apparatus in response to a first predetermined tactile input; and second tactile apparatus for providing an output signal to the clock apparatus in response to each of one or more second predetermined tactile inputs, wherein the clock apparatus is operative to provide output indications of clocked times at which the tactile inputs occur, and wherein the control apparatus is operative to record and process the clocked times.

There is further provided apparatus for remotely identifying the participant, immediately prior to the first and second tactile events, and for providing the identity to the control apparatus, wherein the control apparatus is operative to store the clocked times in association with the participant.

Additionally in accordance with a preferred embodiment of the invention, the apparatus for remotely identifying includes antenna apparatus associated with the microprocessor apparatus; and transmitter apparatus for transmitting to the transceiver apparatus a predetermined signal indication of the identity of the participant with which the transmitter apparatus is associated.

Further in accordance with a preferred embodiment of the invention, the antenna apparatus includes apparatus for generating a magnetic field extending over at least a predetermined range, and the transmitter apparatus includes inductive transponder apparatus which, in response to being exposed to the magnetic field, is operative to transmit to the transceiver apparatus a signal indication corresponding to the identity of the participant.

Additionally in accordance with a preferred embodiment of the invention, in response to receiving the indication of participant identity, the event duration apparatus is operative to provide an indication of the participant identity to the microprocessor apparatus, and the microprocessor apparatus is operative to associate with the identity of a participant a start time associated with each first tactile input, and a finish time associated with each second tactile input, and wherein the microprocessor apparatus is further operative to determine, in accordance with the start and finish times of the participant, preselected performance parameters thereof.

Further in accordance with a preferred embodiment of the invention, the inductive transponder apparatus is located inside a protective housing which is formed so as to be removably mountable onto a preselected portion of the participant.

Additionally in accordance with a preferred embodiment of the invention, the apparatus for remotely identifying includes means for remotely identifying a plurality of participants competing in at least partially overlapping time periods, and the control apparatus is operative to store the clocked times in association with each participant.

Further in accordance with a preferred embodiment of the invention, the apparatus for remotely identifying a plurality of participants competing in at least partially overlapping time periods, includes a plurality of antennae, each associated with a predetermined area and further associated with said microprocessor, each antenna being operative to generate a magnetic field extending across a predetermined area, and the transmitter includes inductive transponder apparatus which, in response to being exposed to said magnetic field, is operative to repeatedly transmit a signal indication corresponding to the identity of the participant, wherein the signal indication is detected by one of the plurality of antennae which is operative to provide the signal indication to the microprocessor which is operative to determine legality of the participant identity to which the signal indication corresponds, and to clock the time and location of the participant if his identity is found to be legal.

In accordance with a further embodiment of the invention, there is provided a system for monitoring a competitive activity in which several distinct groups of participants are participating in at least partially overlapping time periods, and wherein each group has one or more participants.

The system includes a plurality of subsystems, each of which is operative to monitor the performance of the participants in a preselected group, and wherein each subsystem includes subsystem memory apparatus for storing event performance parameters and the identity of each participant in an associated group; clock apparatus, for determining event times of each participant; subsystem control apparatus, associated with the clock apparatus and the memory apparatus, for receiving as input data the event times of each participant, and for determining event performance parameters in accordance therewith, and for storing the parameters in the memory apparatus; and event duration measuring apparatus associated with the subsystem control apparatus, and which includes first tactile apparatus associated with the clock apparatus, for automatically starting the clock apparatus in response to a first predetermined tactile input; and second tactile apparatus for providing an output signal to the clock apparatus in response to each of one or more second predetermined tactile inputs, wherein the clock apparatus is operative to provide output indications of clocked times at which the tactile inputs occur, and wherein the control apparatus is operative to record and process the clocked times.

The subsystem also includes apparatus for remotely identifying each participant, immediately prior to the first and second tactile events, and for providing the identity to the control apparatus, wherein the control apparatus is operative to store the clocked times in association with each participant.

In order to link all the subsystems together, there is also provided hub apparatus operative to communicate with all the subsystems; and central control apparatus associated with the hub apparatus, and operative to receive from each subsystem, via the hub apparatus, the performance parameters of all participants in each group.

There is also provided, in accordance with yet a further embodiment of the invention, a method of monitoring a competitive activity in which several distinct groups of participants are participating in at least partially overlapping time periods, each group having at least one participant, wherein the method includes monitoring from a preselected location the performance of the at least one participant in a preselected group participating in a preselected geographical area, and includes the following steps:

storing event performance parameters and the identity of each participant in the preselected group;

timing the performance of each participant;

receiving as input data the event times of each participant, and determining event performance parameters in accordance therewith, and storing the parameters in a memory;

initiating timing of each participant in response to a first predetermined tactile input at the preselected location;

clocking a performance time of each participant in response to each of at least one second predetermined tactile inputs at the preselected location;

providing output indications of clocked times at which the steps of initiating and clocking occur;

recording and processing the clocked times; and remotely identifying each participant, immediately prior to the steps of initiating and clocking, and storing the clocked times in association with each participant and in association with the preseleted location.

Additionally in accordance with a preferred embodiment of the invention, the method also includes the step of providing to a central location all the performance parameters and locations of all participants in each the group.

Further in accordance with a preferred embodiment of the invention, the step of identifying includes the step of remotely identifying a plurality of participants competing in at least partially overlapping time periods, and the method further includes storing the clocked times in association with each participant, and providing the clocked times as output data to the central location.

Additionally in accordance with a preferred embodiment of the invention, the step of remotely identifying includes the step of transmitting to the preselected location a predetermined signal indication of the identity of a participant.

Further in accordance with a preferred embodiment of the invention, the method also includes the step, immediately prior to the step of transmitting, of generating a magnetic field over at least a predetermined range, and inductively charging a transponder carried by a participant, so as to induce the transponder to transmit a preprogrammed identity code corresponding to the identity of the participant.

Additionally in accordance with a preferred embodiment of the invention, in response to receiving the indication of participant identity, the method further includes the steps of associating with the identity of a participant a start time associated with each the step of initiating, and a finish time associated with each the step of clocking, and wherein the microprocessor means is further operative to determine, in accordance with the start and finish times of each participant, preselected performance parameters thereof.

BRIEF DESCRIPTION OF THE DRAWINGS

The present invention will be more fully understood and appreciated from the following detailed description, taken in conjunction with the drawings, in which.

DETAILED DESCRIPTION OF THE INVENTION

Figure 1:
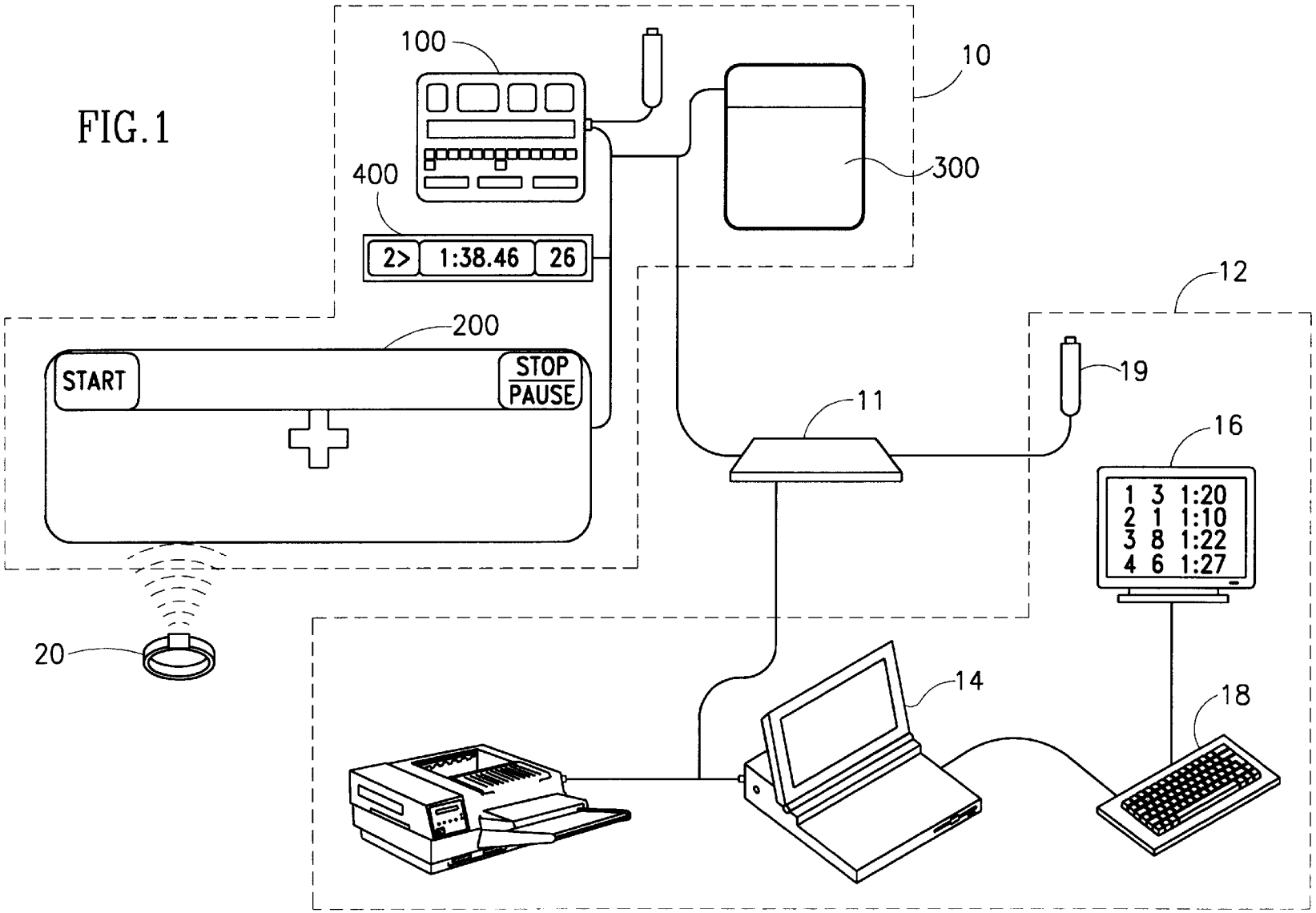
FIG. 1 is a pictorial illustration of a swimming management and training system incorporating a plurality of lane-located subsystems.

Referring now to FIG. 1, it is seen that the system of the invention is formed of a plurality of "lane" systems, referenced generally 10, (also seen in FIG. 2), each of which has autonomous capabilities which enable the provision of computerized on-line swimming workouts and coaching information. Each system 10 is capable of being used simultaneously by several swimmers, typically as many as eight, and of identifying each swimmer and storing performance data of each swimmer separately.

More particularly, as will be appreciated from the following description, the system of the invention provides monitoring of both time and location of all participants in a multi-participant event, regardless as to whether a single person or many persons are participating at the same time, and regardless as to whether the actual event being timed is merely part of a training program or a race.

Figure 3A:
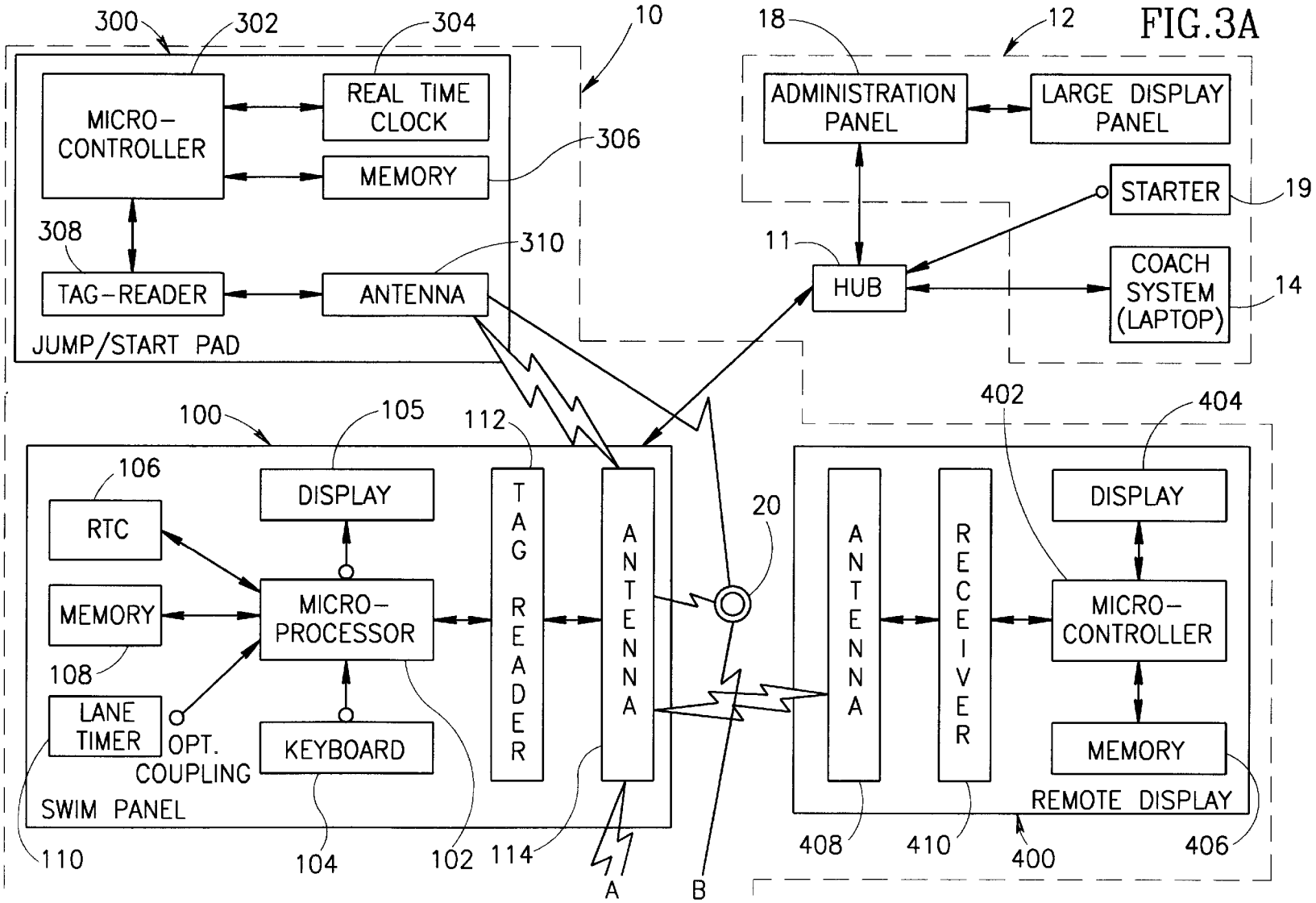
FIGS. 3A and 3B combine to form a block diagram illustration of the system seen in FIG. 1.

As seen in the block diagram illustration of FIG. 3A, the lane systems 10 may be interconnected via a suitable hub 11 to a central control and display system, referenced generally 12, at which is received all performance data generated by all swimmers in all the lanes of a swimming pool. This data can be manipulated, as via a PC-located software-based coaching and competition management system 14, and data may be selected for display on an electronic display or scoreboard 16, as via a keyboard 18 or other equivalent data selection device, shown also as "administration panel." There is also preferably provided a starter control 19, which may be used for starting a competitive swimming event.

Referring now particularly to FIGS. 1, 2, 3A and 3B, a single lane system 10 is now described. Each lane system 10 comprises one or more electronic identification tags 20 which enable identification and thus timing and location monitoring of a swimmer, a "swim" panel 100, a touch pad 200 associated with swim panel 100, a "jump" or "start" pad 300, and a remote display 400.

A single swim panel 100 is located at the beginning of each lane in a swimming pool, and has connected thereto a single touch pad 200. There also exists an option of having a second swim panel and touch pad pair (not shown) at the other end of the lane; in this case, while control is exercised from the swim panel 100 and first touch panel 200 at the beginning or start end of the lane, such that the first swim panel and touch pad pair function as a master unit, the second swim panel and touch pad pair at the other end of the lane functions as a slave unit, subservient to the master unit, recording and displaying recorded information, but without the ability to accept changes in the session.

A further option, in accordance with a further embodiment of the invention, is the operation of touch pad 200 so as to communicate with more than one swim panel 100. It will be appreciated that connection of additional swim panels to a single touch pad allows coaching of different swimmers with more then one workout in the same lane. This flexibility in connection answers different requirements of swimmers and coaches, such that different groups can be coached in a single lane, each using a separate swim panel. It thus also renders possible private training sessions using the swim panel of the invention, alongside a team training session in the same lane.

Referring now to FIG. 3A, each swim panel 100 has a microprocessor 102 to which are connected a data input and selection device or keyboard 104, for inputting various user-selectable options and command, and a display 105, such as a suitable 7-segment or LCD display. There is also provided a real-time clock 106 (RTC), a memory 108 for storing various swimmer parameters, and a lane timer 110. A single lane timer is used for each lane, and effectively enables manual verification of the system findings. While the system is far more accurate and reliable than any manually obtainable readings, lane timer 110 is provided in accordance with requirements of various swimming organizations, the lane timer 110 may be substantially any suitable lane timer as known in the art, and is connected to microprocessor 102 via a suitable optical or RF coupling.

As shown and described below in conjunction with FIGS. 1, 3A, 3B and 4, the system interacts with one or more electronic tags 20 worn by one or more swimmers so as to identify each swimmer and store data developed by him in a separate date file. Remote identification of a swimmer is performed by means of a tag reader 112 and an antenna 114. Antenna 114 is constructed so as to provide an electromagnetic field in the vicinity of the swim panel, thereby to energize the electronic tags 20 by magnetic induction. Antenna 114 is further operative to receive a coded identification signal transmitted via an antenna 22 (FIG. 4), driven by a microchip 24 (FIG. 4), both forming an integral part of electronic tag 20. The tag reader 112 may itself include a microprocessor and apparatus for transforming RF intake into digital signals, these signals being decoded, and subsequently provided as output to microprocessor 102. Antenna 114 is also operative to facilitate optional two-way comununications with other units, in particular, touch pad 200 (FIG. 3B) and jump pad 300.

Alternatively, this two-way communications may be provided instead, or in addition, by direct cable or wiring means with suitable communications protocol.

As mentioned above briefly, each swim panel 100 has a touch pad 200 associated therewith.

As seen in rig. 2, a single touch pad 200 is placed at the end of each lane in a swimming pool, and is positioned generally vertically, adjacent to the end wall 26 of the pool, and is configured so as so to extend across substantially the full width of the lane.

Figure 3B:
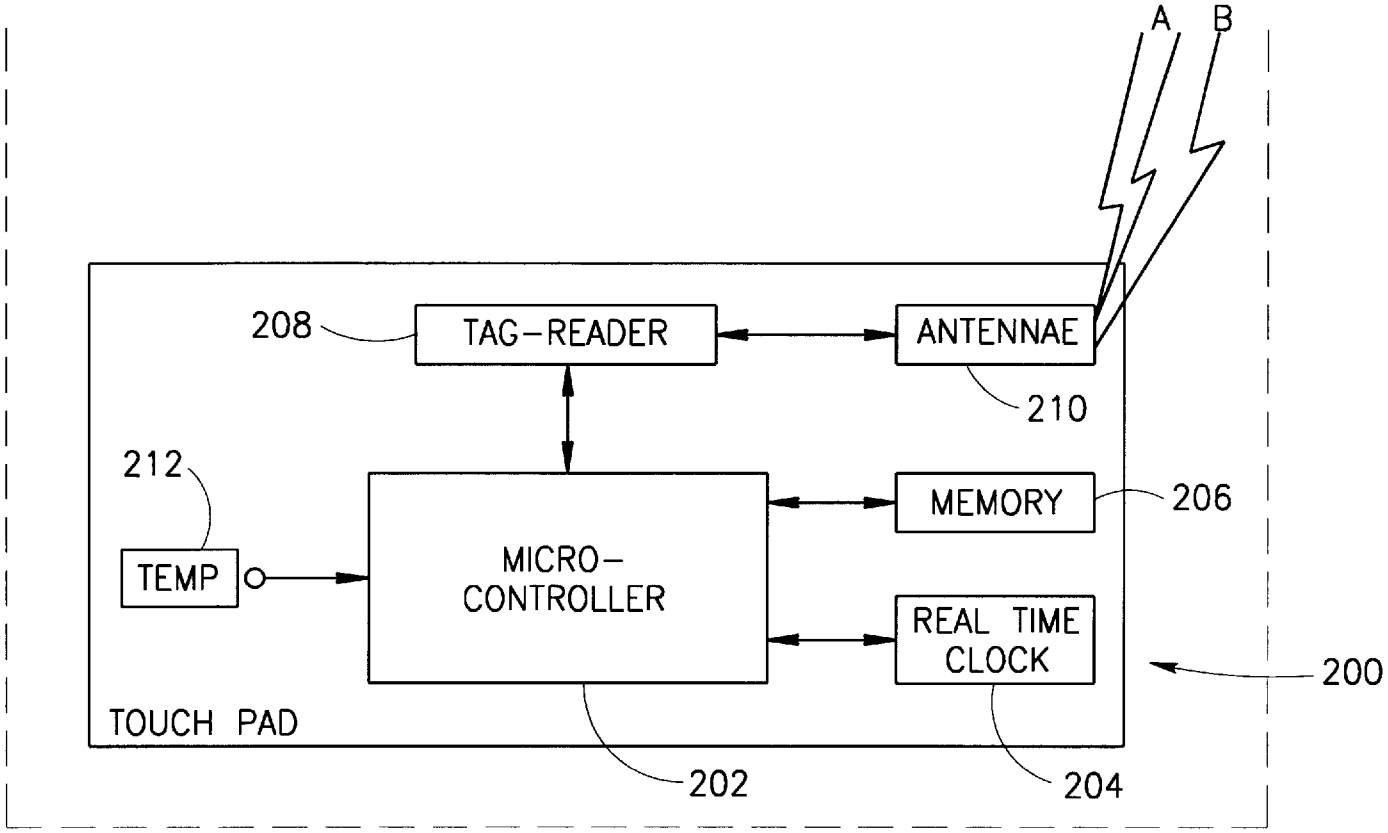

As seen in FIG. 3B, and as described in greater detail below, touching by a swimmer on touch pad 200 generates a signal which is operative to cause the clocked time to be recorded in conjunction with the number of laps or equivalent data that has been clocked until that moment in time, in association with the identity of that swimmer. In order to provide these functions (clocking and identity), and so as also to enable this and possible other relevant data to be transmitted to the associated swim panel 100, touch pad 200 is provided with a microcontroller 202; a real time clock 204, memory 206 and tag reader 208, all of which are connected directly to the microcontroller 202; and an antenna 210 connected to the tag reader 208. The antenna 210 and tag reader 208 are of similar function to those of swim panel 100, which are not described again herein. A temperature sensor 212 may also be provided in conjunction with the touch pad 200, for sensing the temperature of the water in the swimming pool. This data is passed to the swim panel 100 and is used for calculating energy consumption by the swimmer.

Figure 2:
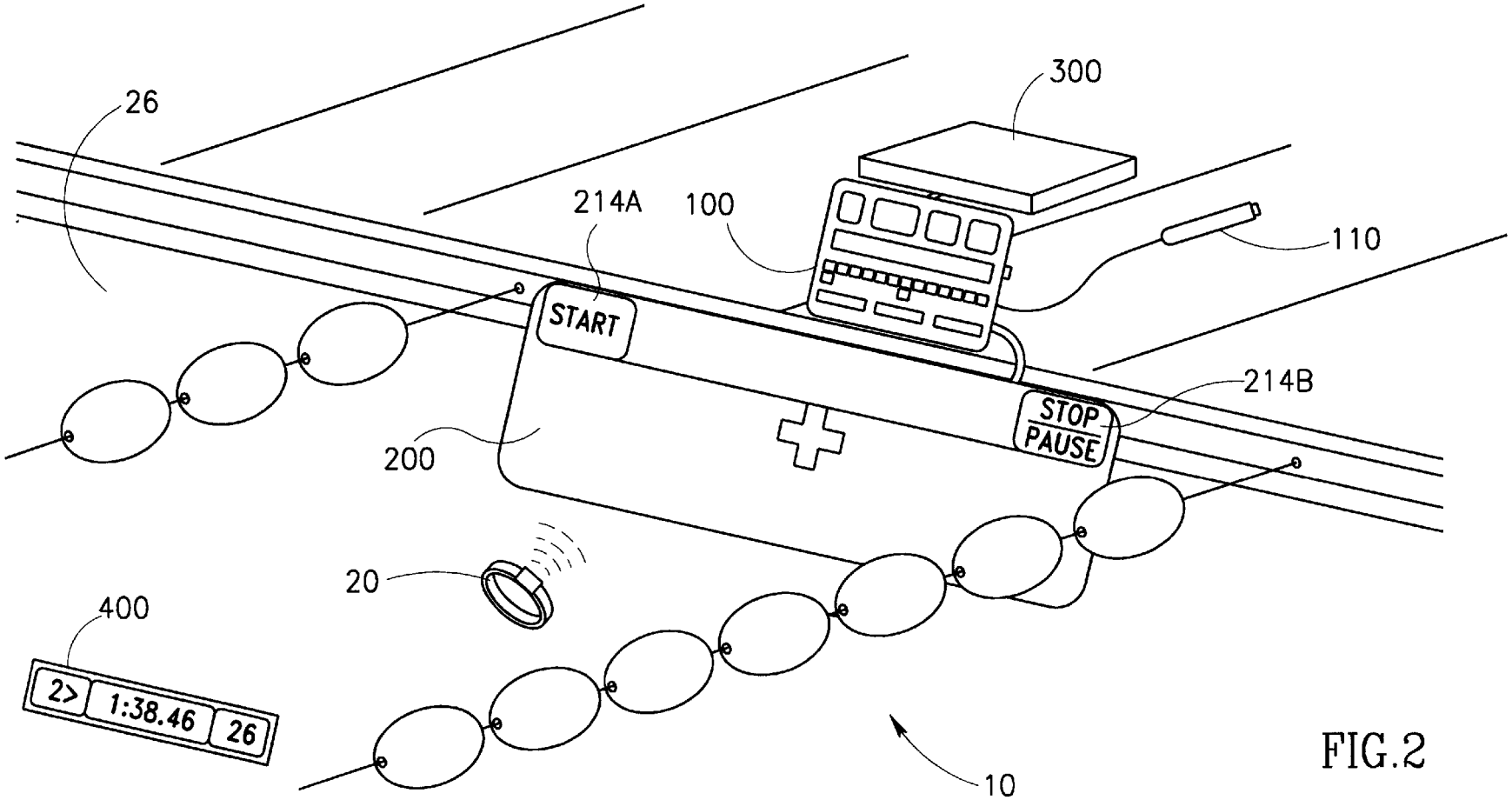
FIG. 2 is a pictorial illustration of a single lane-located subsystem for simultaneously monitoring time and location of each of a plurality of swimmers, wherein the participation times of the swimmers at least partially overlap.

As seen in FIG. 2, a jump or start pad 300 is also connected to each swim panel 100, as mentioned briefly above. A single jump pad 300 is placed adjacent to the "start" end of each lane in a swimming pool. In use, the jump pad 300 of the present invention takes the place of the conventional starting block, such that the instant of departure therefrom corresponds to the start of a lap to be timed. This is particularly useful in team races.

It will thus be appreciated that, in competition, the swimming lane effectively extends from jump pad 300, along the entire double length of the lane, and terminates at an associated touch pad 200.

As seen in FIG. 3A, jump pad 300 is provided with a microcontroller 302; a real time clock 304, memory 306 and tag reader 308, all of which are connected directly to the microcontroller 302; and an antenna 310 connected to the tag reader 308. The antenna 310 and tag reader 308 are of similar function to those of touch pad 200, which are not described again herein.

It will thus be appreciated that, when a user stands on jump pad 300 thereby applying even the slightest touch pressure thereto, an electrical signal is provided to an optional microcontroller 302, which is operative to reset clock 304 and to read the electronic identification tag 20 carried by the swimmer. When this touch pressure is removed, i.e. at the time that a swimmer's feet leave the pad when diving into the swimming pool, a further signal is provided to microcontroller 302, which is operative to start clock 304. Subsequent touching of an associated touch pad 200 (FIG. 2) by a swimmer causes a lap time to be clocked in respect of the swimmer.

Referring now to FIGS. 3A and 3B, it will be appreciated that microprocessor 102 of jump pad 100 is operative to gather data from the respective real time clocks 204 and 304 of touch pad 200 and jump pad 300, and also from the tag readers thereof, in respect of the identities of the swimmer or swimmers whose times are being measured, thereby to record, inter alia, start times received from jump pad 300, and finish times received from touch pad 200, for each swimmer.

Figure 5:
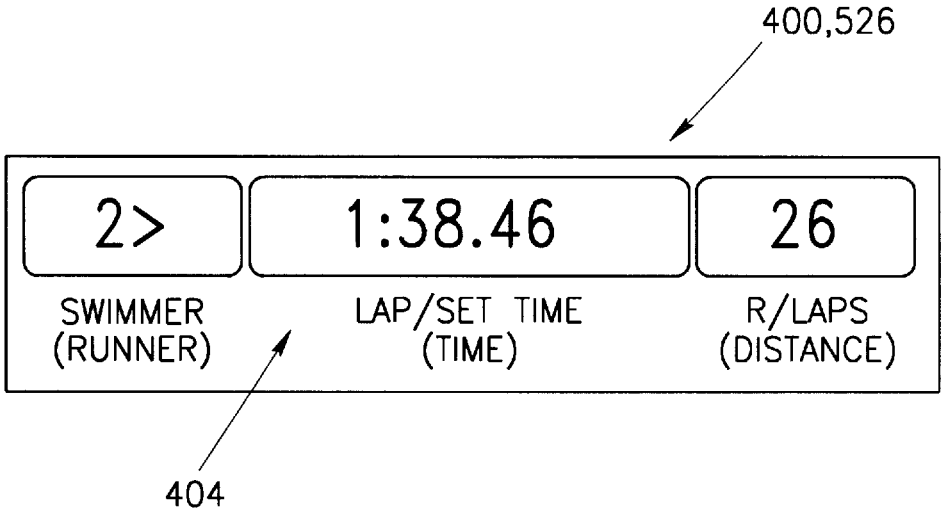
FIG. 5 is an enlarged view of a remote display, typically as seen in FIGS. 1 and 2, for swimming applications, and as seen in FIG. 8, for track events.

Referring now also to FIG. 5, there may further be associated with each swim panel 100 a remote display unit 400, for displaying results in preselected format of each swimmer or race participant. Preferably, as indicated in FIG. 2, the display is an underwater display, located at a distance of about 4 m from the end wall 26 of the swimming pool. As seen in FIG. 3A, display unit 400 is driven by a microcontroller 402, and includes a suitable visual display screen 404, such as an illuminated LCD, alphanumeric or 7-segment display, and a memory 406 associated with the microcontroller 402. There is also provided means for communicating with an associated swim panel 100 so as to received therefrom results to be displayed, including, in the illustrated example, a suitable RF antenna 408 and receiver 410 for transferring data received from its received, e.g. RF format, to a digital format for use by microcontroller 402.

It will be appreciated that the display of FIG. 5 may also be used in conjunction with other types of event, such as track events. Accordingly, a further description of FIG. 5 is provided in conjunction with the track event monitoring system shown and described below in conjunction with FIG. 8.

It will be appreciated that the system of the present invention is capable of monitoring, as described above, any preselected number of lanes, with any preselected number of swimmers in each lane. Typically, the system is adapted to monitor ten lanes with eight swimmers swimming in each isle.

Figure 6:
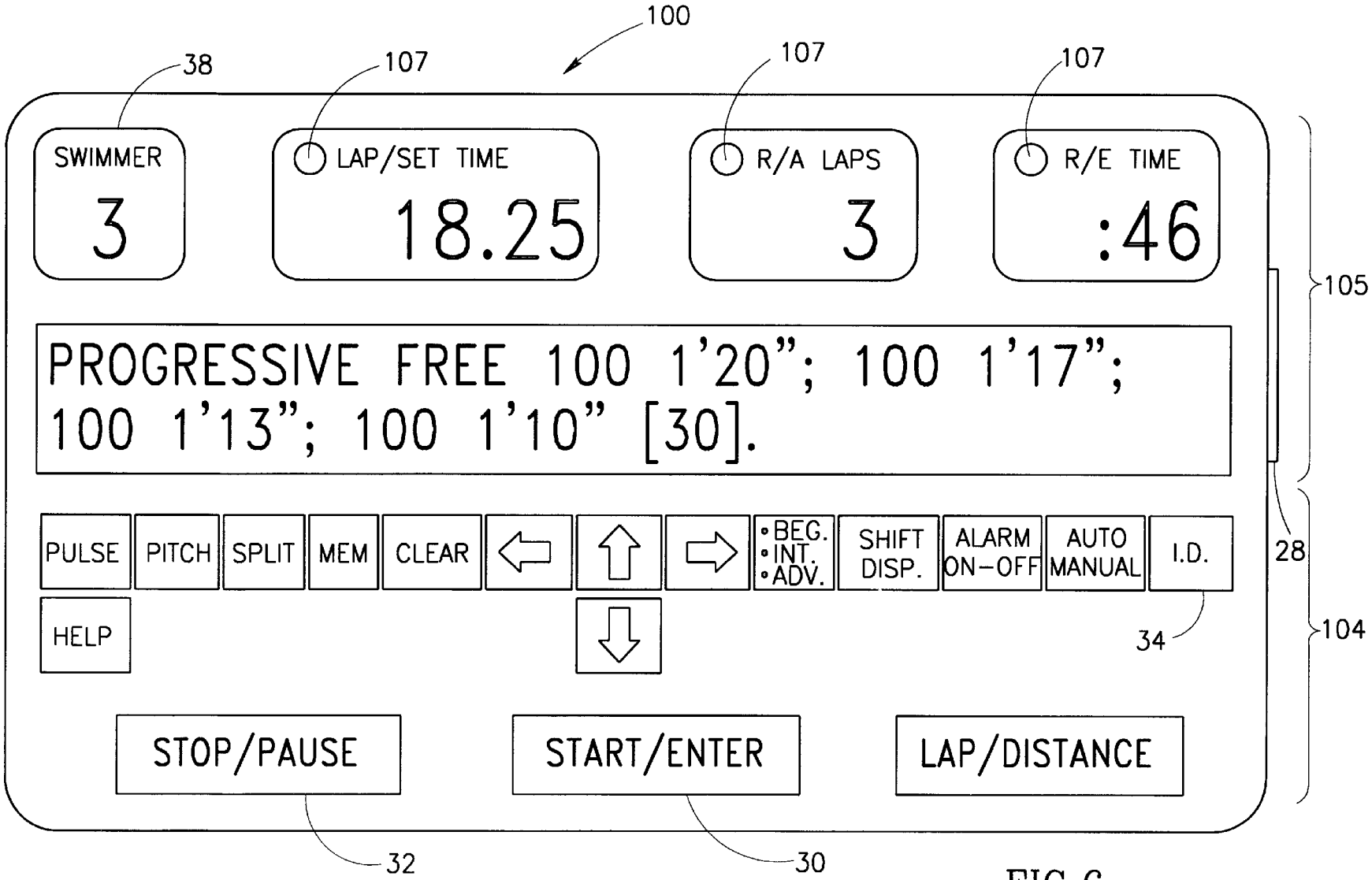
FIG. 6 is a detailed view of a swim panel seen in FIGS. 1, 2 and 3A and 3B.

Referring now particularly to FIG. 6, keyboard 104 is formed with a plurality of push keys or buttons, all of which may be used by a swimmer to access and operate a self-coaching program, and to enable him to monitor his performance. The push keys include an ON/OFF or power switch 28, a START/ENTER switch 30 for selecting and starting a swimming program, and a STOP/PAUSE switch 32 which may be used by the swimmer to initiate a selected program. There is also provided an ID switch 34, which may be used to enter the identity of a swimmer, so that it is possible to associate each swimmer using the panel 10, with data generated by his performance.

The START/ENTER switch 30, the STOP/PAUSE switch 32 and a LAP/DISTANCE key 33 have a relatively large size, thereby to enable time recording and lap counting during swimming events without necessarily having to connect the touch pads 200.

The remaining switches are primarily for various software driven calculation and display functions, and facilitate the storing of instructions for coaching workouts and the display—in real time—of various parameters associated with one or more swimmers swimming in the lane. Additional keys enable real time swimming memory-associated measurements, including stopwatch functions, measurement of stroke frequency, stroke distance and heart pulse rate. A special editing function allows the entry and deletion of individually configured "personal" workouts; it being possible to preprogram many personal workouts for storage and later use.

As seen in FIG. 6, visual display 105 is preferably located at an upper portion of swim panel 100. Display 105 is divided into different portions. In the illustrated embodiment, a first display portion 38 is operative to display the identity of a swimmer. In operation, the identity of a swimmer may either be entered manually by use of ID switch 34, or it may be detectable automatically.

Remaining portions of display 105 may be operative to display two different selectable functions, a selected function being indicated by an illuminated LED, referenced 107, located adjacent to the display portion. These further display portions are operative to display various parameters, which may include set and lap times; accumulated or remaining laps; swimming speed; average lap times; accumulated distances; energy consumption; and elapsed and accumulated workout time. It will be appreciated that these functions, as well as other optional functions not mentioned herein, are primarily software driven and are thus not described herein in detail.

Referring briefly once again to FIG. 1, it is seen that, while swim panels 100 may be used in a totally autonomous fashion, they may also be connected via hub 11, in network fashion, to a coaching and administration system operated from computer 14. This is particularly useful when using the system for coaching a team of swimmers or for managing a competition; in either case, it is possible to fully manage a large number of swimmers and to record all parameters which may be useful either for assessing their performance and for designing training programs (in the case of team coaching), or to fully analyze competition results.

Figure 4:
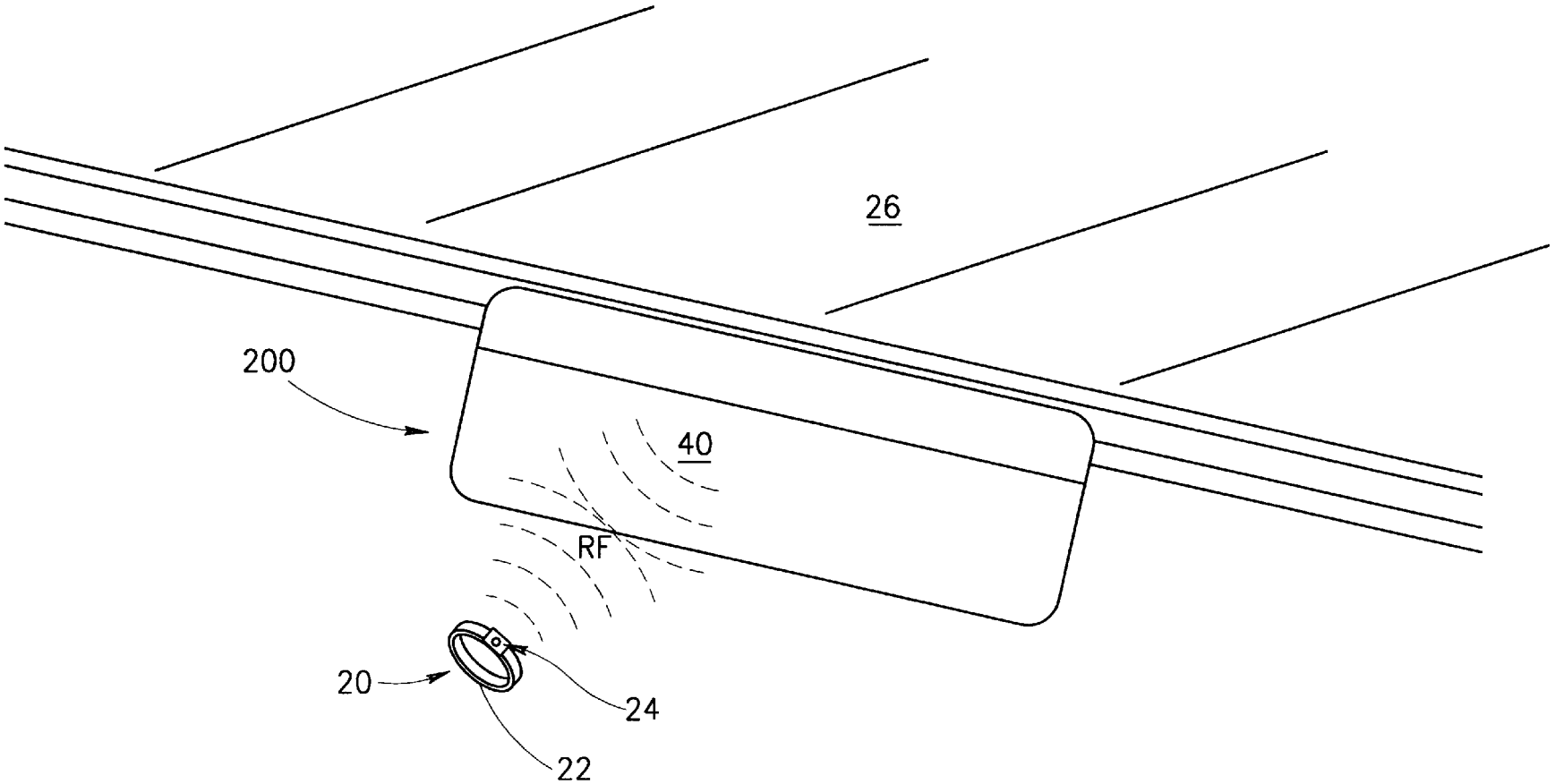
FIG. 4 is a diagrammatic illustration of an electronic transponder tag used for electronic identification of a swimmer, and of its interaction with the subsystem of FIG. 2.

Referring now to FIG. 4, electronic tag 20 is constructed to be totally passive, such that no battery is required. Tag 20 is essentially a transponder which is formed of a microchip 24, preprogrammed with a unique ID code by which a user may be identified, and an attached antenna coil 22. Antenna coil 22 is used both for reception and transmission when communicating with lane system 10, and for inductive charging of microchip 24 by any of touch pad antenna 210, jump pad antenna 310, and swim panel antenna 114.

As mentioned briefly above, both the antenna 114 of swim panel 100 and the antenna 210 of touch pad 200 generate a magnetic field, shown schematically at 40 in FIG. 4, extending inwards from wall 26 into the swimming pool. As tag 20 passes through the magnetic field 40, microchip 24 becomes inductively charged, as described, via antenna coil 22, causing automatic transmission of the preprogrammed ID code from the microchip 24, via antenna 22, to antennae 114 or 210 of swim pad 100 and touch pad 200, respectively. Transmission of the ID code may occur, by way of example, at a rate of 106,000 bits per second.

The shape of the transponder antenna 22 effectively defines the shape of the entire tag 20. In the illustrated embodiment, the entire tag is encased in a thin plastic band, which can be worn on the finger of a swimmer. In practice, so as to ensure very high accuracy to within 0.01 seconds, a swimmer may wear up to four different transponder tags, one on the finger of each hand and one on the toe of each foot. This ensures substantially foolproof detection of the swimmer (via his ID code), bearing in mind that different swimmers may have different styles which may result in their touching the end of the lane (i.e. a touch pad 200) in different ways. Preferably, detection of the swimmers ID code occurs at a distance of up to about 2.5 mm from the touch pad.

While the above, four-ring arrangement may be required for professional swimmers or for competition purposes, a single electronic tag, giving a timing accuracy of 0.1 second, may be used in conjunction with goggles, a wristband, or as a ring or anklet. This may be sufficient in the case of amateur swimmers swimming purely for exercise, fitness clubs, swimming lessons at schools or coaching.

It will be appreciated that tags 20 are made to withstand the harsh environment commonly found in a swimming pool. Because the transponder chip is so small, typically having dimensions of 6 mm×9 mm×0.25 mm, it is molded into or incorporated in plastic objects that swimmers carry while swimming; these may include a band as seen in FIG. 4, or goggles wristbands, rings or anklets, for example, as described above.

While detection may occur, as described above, at a range of approximately 2.5 mm, different transponders and tag detector constructions may be used so as to increase or decrease this range, as well as the timing accuracy. It will also be appreciated that the orientation of the transponder and the touch pad scanner antennas with respect to each other can also affect the read range. The greatest read range is achieved when the antenna and the transponder coil are in parallel planes.

The touch pad 200 may be of any suitable construction, and is therefore not described herein in detail. A suitable construction may be that disclosed in U.S. Pat. No. 3,944,763, entitled "Swimming Pool Touch Pad," the contents of which are incorporated herein by reference. In use, when a swimmer touches the touch pad, thereby to apply thereto a slight pressure, an electrical circuit is closed causing provision of an electrical output signal, thereby providing a "timing signal" to the microcontroller 202 of the touch pad, which reads the clocked time at that instant. The construction of the present touch pad 200 is that of a large keypad, and it may have a construction similar to any of those manufactured by Best Electronics Ltd. of Kowloon, Hong Kong, under the name "Membrane Switch™" or the Hall Company, of 420 East water Street, Urbana, Ohio, USA, or marketed under the trade name SAK™ Rubber Keypad Series.

The construction and operation of jump pad 300 are generally similar to those of touch pad 200, and the construction of jump pad 300 is thus not described herein.

Following the recording of the clocked time, tag reader 208 of the touch pad is operative to communicate with electronic tag 20 via touch pad antenna 210, in order to retrieve the coded identity of the tag, and thereby to identify the swimmer and to record the clocked time in association with the swimmer. The tag transponder responds by transmitting its code repeatedly until the tag reader 208, having duly recorded and confirmed the code, sends to the tag a STOP command.

The touch pad tag reader 208 is preferably constructed so as to be able to communicate with many different swim panels 100, each swim panel being operative to run one workout at a time. Accordingly, a number of groups or individuals using different workouts may be operative to use a plurality of different swim panels 100, via a single touch pad 200.

As seen in FIG. 2, touch pad 200 preferably includes large START and STOP/PAUSE buttons, respectively referenced 214A and 214B, which combine the respective "start" and "stop" functions of buttons 30 and 32 of the swim panel 100 (FIG. 6), by which a swimmer may initiate or stop a selected program. A user may press buttons 214A or 214B at his convenience, to indicate the beginning or end of a timed session.

When the STOP/PAUSE button 214B is pressed during session recording it is interpreted as PAUSE which stops the swimmer-session recording until the START button is repressed.

As described, several swimmers may be present in a single lane simultaneously. Referring now briefly to FIG. 4, in the event that more than one electronic tag 20 is detected in the magnetic field 40, the touch pad tag reader 208 uses an anti collision algorithm to distinguish between the codes being transmitted. By way of example only, a detection and reading cycle may take 2 ms for the first detected tag transponder and an additional 1 ms for every subsequent transponder present in the magnetic field.

The respective antennae 210 of two adjacent touch pads 200 can be configured to allow broad applications, such as in a competition in which two swimmers compete in the same lane; in such a case, the antennae can be multiplexed so as to divide the detection areas in half.

Figure 7:
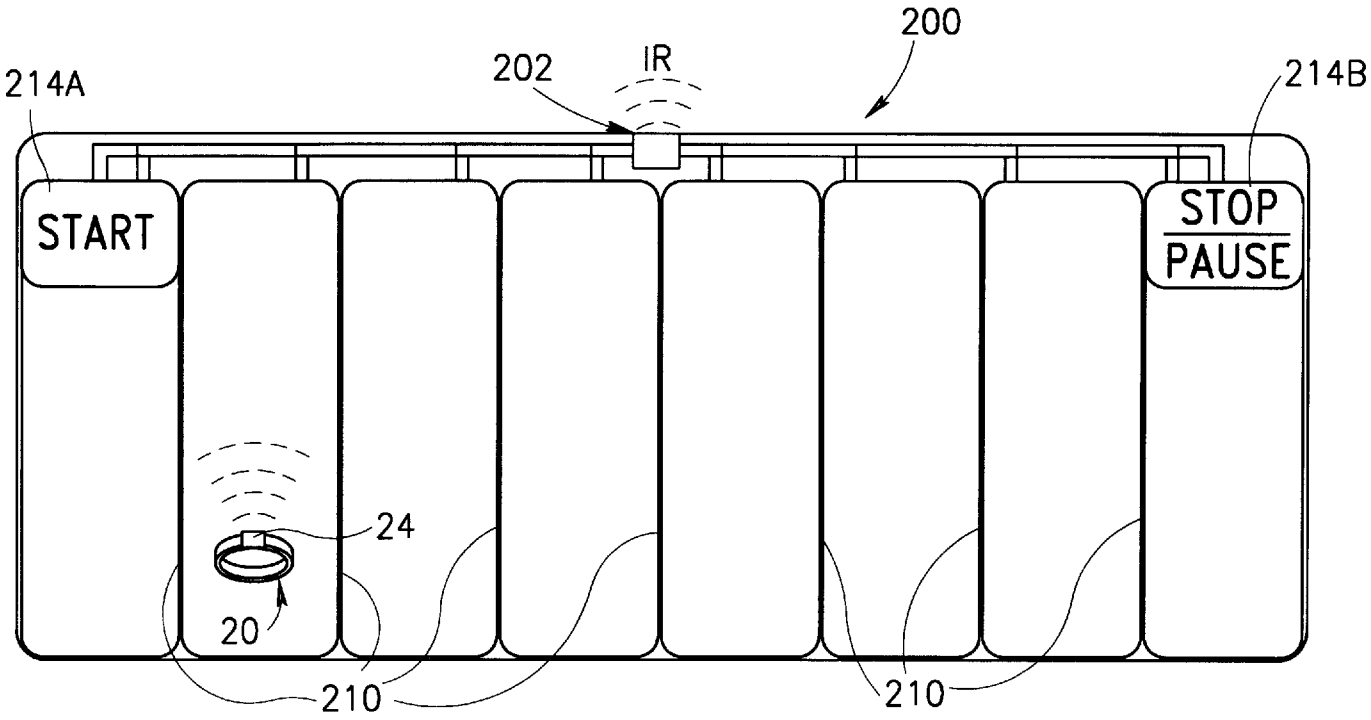
FIG. 7 is a diagrammatic view of a touch pad of the present invention, showing the location of plural antennae therein.

As seen in FIG. 7, touch pad 200 is made of a plurality, typically eight antennae 210. When the touch pad 200 is touched in the area of one of antennae 210, the touched antenna 210 is activated, thereby inductively charging the microchip 24 of tag 20 of the swimmer that touched the touch pad. As soon as the microchip 24 becomes charged, it automatically transmits its identifying code or ID. The antenna 210 of touch pad 200 is operative to detect the transmission from tag 20, and sends the detected ID to microcontroller 202 for verification. If the detected ID is 'rejected' by microcontroller 202, i.e. the code is an illegal code (for example, it is transmitted by a swimmer in an adjoining lane), it is ignored, and the touch pad antenna 210 returns to a 'sleep' or passive mode.

If the ID code is accepted by the touch pad microcontroller 202, it transmits a STOP signal to the tag 20, via the appropriate antenna 210; consequently, the tag microchip 24 ceases transmitting.

The above-described segmentation of touch pad 200, such that a predetermined antenna 210 monitors a predetermined area, allows the detection of a plurality of swimmers, each being monitored by a different antenna (but not necessarily the same one each time). It will be appreciated that this arrangement, together with the fact that the touching time is considerably longer than the ID detection time, permit multiple swimmer participation in the same swimming lane, and enables transmissions that overlap in time to be dealt with, each by a separate antenna, thereby avoiding "collision" and confusion of clocked results and locations.

In the event that two swimmers are detected by the same antenna, an anti-collision algorithm is operative to reschedule the transmissions, deciding to detect the transmission of the tag of one swimmer first, and the transmission of the tag of the other swimmer second, after a delay in the region of 1 ms.

Figure 8:
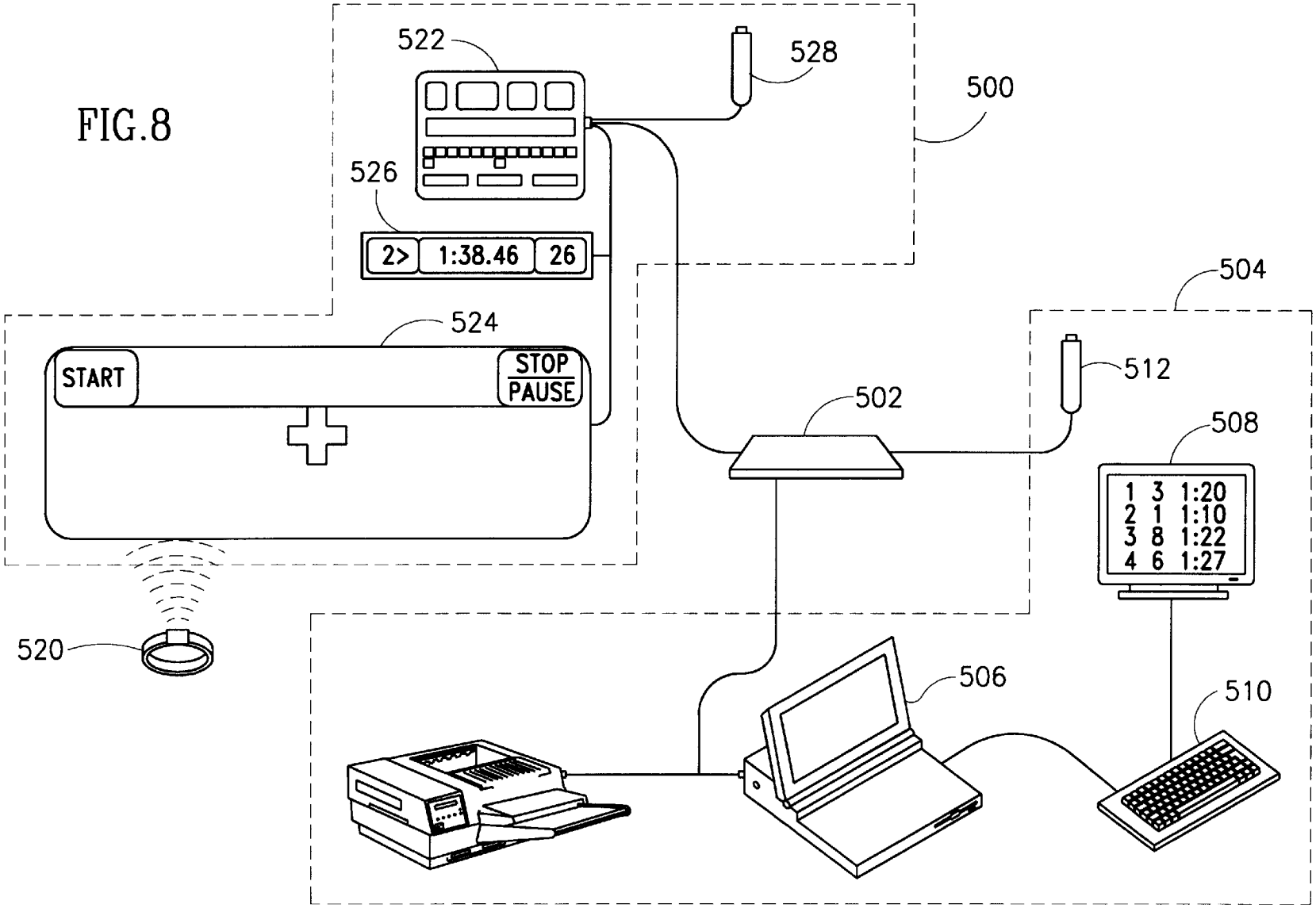
FIG. 8 is a pictorial illustration of a track event monitoring system, constructed and operative in accordance with an alternative embodiment of the present invention.

Referring now to FIG. 8, it is seen that the time and location monitoring system of the present invention is also configured for use in other "track" events; in the present description, the term "track" is intended to mean any multiple participant event which it may be sought to divide into laps, segments or other portions or stages, and in which it may be desired to monitor the time and location of any or all participants at a plurality of predetermined stages of the event. This may include running events, cycling, and so on.

It is thus seen that the system of the present invention, described above in conjunction in association with a swimming pool and swimming events, is applicable, as mentioned, to track events.

As seen in FIG. 8, there is provided a system which may be formed of one or more "lane" systems 500, each of which has autonomous capabilities which enable the provision of computerized on-line e.g. running workouts and coaching information. Each system 500 is capable of being used simultaneously by several athletes, and of identifying each athlete and storing his performance data separately.

More particularly, the system of the present embodiment provides monitoring of both time and location of all participants in a multi-participant track event, regardless as to whether a single person or many persons are participating at the same time, and regardless as to whether the actual event being timed is merely part of a training program or a race.

Lane systems 500 may be interconnected via a suitable hub 502 to a central control and display system, referenced generally 504, at which is received all performance data generated by all athletes in all the lanes of a sport track. This data can be manipulated, as via a PC-located software-based coaching and competition management system 506, and data may be selected for display on an electronic display or scoreboard 508, as via a keyboard 510 or other equivalent data selection device. There is also preferably provided a starter control 512, which may be used for starting a competitive swimming event.

It is furthermore seen that each lane system 500 comprises one or more electronic identification tags 520 which are similar to tags 20, shown and described above in conjunction with FIGS. 1–7, and which may be worn, preferably on the rummy shoe of an athlete or may be mounted onto the rim of a bicycle wheel, and which enable identification and thus timing and location monitoring of an athlete. Each lane system further provides, a "track" panel 522, analogous to swim panel 100; a touch pad 524 of which a plurality may be embedded in the track at predetermined regular intervals, associated with track panel 522 and similar in function to touch pad 200; and a remote display 526 which, as seen in enlarged view in FIG. 5, may be used to display the number or other identity of the runner, his accumulated running time, and the number of laps that have passed or that remain. A starter control 528 may also be provided with each lane system.

Further to the description herein of the track event system, the various system components shown and described herein are analogous to system components shown and described above in conjunction with FIGS. 1–7, as mentioned, and the system of the present invention is to be understood as operating in a similar manner, save for minor adjustments due to the fact that the present system is a track system and not a swimming system, as stated.

It will be appreciated by persons skilled in the art that the scope of the present invention is not limited by what has been shown and described hereinabove, merely by way of example. Rather, the scope of the invention is defined solely by the claims, which follow.

I claim:

1. A system for monitoring the time and location of plurality of participants competing in at least partially overlapping time periods in a competitive event occurring between predetermined start and finish locations, which comprises:

(a) memory means for storing event performance parameters and the identity of all the participants, (b) clock means, for determining event times of the participants;

(c) control means, associated with said clock means and said memory means, for receiving as input data the event times of the participants, and for determining event performance parameters in accordance therewith, and for storing said parameters in said memory means;

(d) event duration measuring means associated with said control means comprising:

(i) first tactile means associated with said clock means, and located at the event start location, for automatically starting said clock means in response to a first predetermined tactile input signifying start of the event; and (ii) second tactile means, located at the event finish location, for providing an output signal to said dock means in response to each of at least one second predetermined tactile inputs signifying finish of the event, wherein said dock means is operative to provide output indications of clocked times at which said tactile inputs occur, and wherein said control means is operative to record and process said clicked times; and (iii) means, located at a predetermined location, for remotely identifying each of the participants, immediately prior to each of said first and second tactile events, and for providing said identities to said control means, wherein said control means is operative to store said clocked times in association with each participant and in association with said predetermined location, wherein said second tactile means located at the event finish location includes a segmented touch pad, which contains a plurality of antennae, each being associated with a predetermined area associated with the finish location, and associated with said control means, each antenna being operative to generate a magnetic field extending across a predetermined area associated with the finish location, and being further operative to dock an event time in response to a tactile input thereat;

and wherein said means for remotely identifying a plurality of participants competing in at least partially overlapping time periods, includes said segmented touch pad; and said means for remotely identifying also includes a plurality of inductive transponder worn by the plurality of participants, each being operative, in response to being exposed to said magnetic field, to repeatedly transmit a signal indication corresponding to the identity of a participant by which it is being worn, wherein said signal indication is detected by one of said plurality of antennae and said one antenna is operative to provide said signal indication to said control means which is operative to determine legality of the participant identity to which said signal indication corresponds, and to dock the event time associated with said tactile input and to store it in association with the participant identity, if the participant identity is found to be legal.

2. A system according to claim 1, wherein, if the identity of the participant is found to be legal, said control means is operative to drive said antenna to transmit a STOP signal to said inductive transponder means, thereby to cause it to stop transmitting the participant identity signal indication.

3. A system according to claim 2, wherein, said control means includes an anti-collision algorithm which, on detection of two or more signal indications from different transponders, operates said means for remotely identifying so as to select and process date relating to a first of the two or more participants, and so as, thereafter, to ignore transmissions relating to the first participant and to select and process data relating to the second of the two or more participants.

* * * * *